US011095063B2

(12) United States Patent
Chiba et al.

(10) Patent No.: US 11,095,063 B2
(45) Date of Patent: Aug. 17, 2021

(54) TERMINAL METAL FITTING AND ENGAGEMENT STRUCTURE OF TERMINAL METAL FITTING AND HOUSING

(71) Applicant: Yazaki Corporation, Tokyo (JP)

(72) Inventors: Shingo Chiba, Makinohara (JP); Naokazu Nagasaka, Makinohara (JP); Dacheng Jin, Makinohara (JP); Atsuhito Saito, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 16/419,569

(22) Filed: May 22, 2019

(65) Prior Publication Data

US 2019/0393638 A1 Dec. 26, 2019

(30) Foreign Application Priority Data

Jun. 26, 2018 (JP) ..... JP2018-121086

(51) Int. Cl.
*H01R 13/424* (2006.01)
*H01R 4/18* (2006.01)
(Continued)

(52) U.S. Cl.
CPC ..... *H01R 13/424* (2013.01); *H01R 4/185* (2013.01); *H01R 13/11* (2013.01); *H01R 13/113* (2013.01); *H01R 13/187* (2013.01); *H01R 13/42* (2013.01); *H01R 13/422* (2013.01); *H01R 13/426* (2013.01); *H01R 13/4223* (2013.01); *H01R 13/447* (2013.01); *H01R 13/5202* (2013.01);
(Continued)

(58) Field of Classification Search
CPC ..... H01R 13/113; H01R 13/4223; H01R 13/187; H01R 13/422; H01R 13/11; H01R 13/426; H01R 13/62927; H01R 13/42; H01R 13/5213; H01R 13/73; H01R 13/5202; H01R 13/447; H01R 25/006; H01R 24/78; H01R 4/185; H01R 13/424
USPC ..... 439/595, 752, 851, 852
See application file for complete search history.

(56) References Cited

U.S. PATENT DOCUMENTS 5,593,328 A 1/1997 Okada et al.
8,784,144 B2 7/2014 Hirabayashi et al.
(Continued)

FOREIGN PATENT DOCUMENTS

EP 0652605 A1 5/1995
EP 1786065 A1 5/2007
(Continued)

OTHER PUBLICATIONS

Jul. 14, 2020—(JP) Office Action—App 2018-121086.

*Primary Examiner* — Abdullah A Riyami
*Assistant Examiner* — Justin M Kratt
(74) *Attorney, Agent, or Firm* — Banner & Witcoff, Ltd.

(57) ABSTRACT

A terminal metal fitting (10) includes a tubular box portion (11) receiving a counterpart terminal; a lock hole (14) formed through a wall (11*a*) of the box portion (11) and receiving the lock projection (25); a terminal spring (16) extending from an inner wall surface of the box portion (11) to press and contact to the counterpart terminal; and a supporting point portion (15) formed at a portion around the lock hole (14) to have a cantilevered-shape. The supporting point portion (15) serves as a supporting point (15*a*) when the terminal spring (16) contacts to the counterpart terminal.

4 Claims, 4 Drawing Sheets

(51) Int. Cl.

| | |
|---|---|
| ***H01R 13/11*** | (2006.01) |
| *H01R 13/422* | (2006.01) |
| *H01R 24/78* | (2011.01) |
| *H01R 13/426* | (2006.01) |
| *H01R 25/00* | (2006.01) |
| *H01R 13/187* | (2006.01) |
| *H01R 13/52* | (2006.01) |
| *H01R 13/42* | (2006.01) |
| *H01R 13/447* | (2006.01) |
| *H01R 13/629* | (2006.01) |
| *H01R 13/73* | (2006.01) |

(52) U.S. Cl.
CPC .... *H01R 13/5213* (2013.01); *H01R 13/62927* (2013.01); *H01R 13/73* (2013.01); *H01R 24/78* (2013.01); *H01R 25/006* (2013.01)

(56) References Cited

U.S. PATENT DOCUMENTS

| | | | | |
|---|---|---|---|---|
| 8,845,362 | B2 | 9/2014 | Chikusa et al. | |
| 8,858,259 | B2 * | 10/2014 | Chikusa | H01R 13/4223 439/595 |
| 9,954,300 | B2 * | 4/2018 | Nagasaka | H01R 13/111 |
| 2013/0065436 | A1 * | 3/2013 | Hirabayashi | H01R 13/4223 439/595 |
| 2018/0034185 | A1 | 2/2018 | Nagasaka et al. | |
| 2018/0083380 | A1 * | 3/2018 | Goto | H01R 24/20 |

FOREIGN PATENT DOCUMENTS

| | | | |
|---|---|---|---|
| EP | 2571105 | A1 | 3/2013 |
| JP | 2013-062167 | A | 4/2013 |
| JP | 2014-216256 | A | 11/2014 |
| JP | 2018-018703 | A | 2/2018 |

* cited by examiner

TERMINAL METAL FITTING AND ENGAGEMENT STRUCTURE OF TERMINAL METAL FITTING AND HOUSING

CROSS-REFERENCES TO RELATED APPLICATION(S)

This application is based on and claims priority from Japanese Patent Application No. 2018-121086 filed on Jun. 26, 2018, and the entire contents of which are incorporated herein by reference.

BACKGROUND

Field of the Invention

The present invention relates to a terminal metal fitting and an engagement structure of terminal metal fittings and a housing.

Description of Related Art

Engagement structures of a housing and terminal metal fittings are known in which a terminal metal fitting is prevented from coming off each terminal housing chamber of the housing unintentionally by engaging a lance (lock projection) provided in the terminal housing chamber with a lock hole (lance hole) of the terminal metal fitting.

As for details of the above structures, refer to JP 2014-216256 A.

SUMMARY

The above-described conventional engagement structures are based on a prerequisite that a terminal metal fitting that is locked by a lance cannot move rearward in the housing direction unless the locking by the lance is canceled. However, in actuality, there may occur an event that a portion (e.g., thin-plate-like lock piece) of a terminal metal fitting bites into the associated lance if the terminal metal fitting is pulled by an electric wire connected to the terminal metal fitting and thereby pressed against the lance when, for example, the electric wire receives a strong external force during its wiring. In that event, the terminal metal fitting is moved rearward in the housing direction by a biting length.

When a portion of a terminal metal fitting bites into the associated lance, not only is the terminal metal fitting displaced rearward in the housing direction but also it may be inclined in such a direction as to cross the housing direction. If the terminal metal fitting suffers such a positional deviation that is excessive, when it is attempted to fit the housing into or with a counterpart housing, the terminal metal fitting cannot come into proper contact with a counterpart terminal to make the electrical contact between them improper. Furthermore, when excessive biting has occurred, there may occur an event that the engagement between the lance and the terminal metal fitting cannot be maintained to cause such a large positional deviation that the terminal metal fitting goes out of the terminal housing chamber. It is preferable that such a positional deviation of a terminal metal fitting be prevented to as low a probability as possible.

An object of the invention is to provide a terminal metal fitting and an engagement structure of a housing and terminal metal fittings that make it possible to suppress positional deviation of a terminal metal fitting in each terminal housing chamber of the housing.

Embodiments of the present invention provide the following items (1) to (3):

(1) A terminal metal fitting locked in a terminal housing chamber by using a lock projection provided in a housing, the terminal metal fitting comprising:

a tubular box portion receiving a counterpart terminal;

a lock hole formed through a wall of the box portion and receiving the lock projection;

a terminal spring extending from an inner wall surface of the box portion to press and contact to the counterpart terminal; and a supporting point portion formed by cutting a portion around the lock hole and erecting the cut portion inside of the box portion to have a cantilevered-shape, the supporting point portion serving as a supporting point upon the terminal spring pressing and contacting to the counterpart terminal.

(2) The terminal metal fitting according to the item (1), wherein the terminal spring extends to stride the lock hole and is located to eliminate a contact with the lock projection received through the lock hole; and the supporting point portion supports the terminal spring to restrict deformation of the terminal spring toward the lock projection.

(3) An engagement structure of a terminal metal fitting and a housing, the engagement structure comprising:

the terminal metal fitting according to the item (1) or the item (2); and the housing having a terminal housing chamber to receive the terminal metal fitting and a lock projection to lock the terminal metal fitting in the terminal housing chamber.

According to first aspect of the invention, relating to the item (1), the opening area of the lock hole is increased because the portion around the lock hole is cut and erected. It becomes possible to use a larger lock projection by the increase of the opening area of the lock hole. The use of a larger lock projection allows itself to withstand deeper biting even if an end surface of the lock hole bites into the lock projection when, for example, the terminal metal fitting is used. As a result, positional deviation of the terminal metal fitting in the terminal housing chamber can be suppressed more properly.

According to second aspect of the invention, relating to the item (2), the space between the lock hole and the terminal spring can be used as a space for receiving the lock projection. As a result, the internal space of the box portion 11 of the terminal metal fitting can be utilized effectively. Moreover, even if the terminal spring is pushed in such a direction as to come closer to the lock projection by a counterpart terminal inserted into the box portion of the terminal metal fitting, since the deformation of the terminal spring toward the lock projection is restricted by the supporting point portion, the interference of the terminal spring with the lock projection is suppressed. With these features, the terminal metal fitting 10 can be miniaturized without impairing its function.

Furthermore, since the terminal metal fitting can be miniaturized as described above, it is possible to give the terminal metal fitting an additional function. For example, a portion to engage with a retainer, spacer, etc. for doubly locking the terminal metal fitting on the housing can be provided at a position (e.g., a position on the side of the rear end of the box portion) that is closer to the tip of the terminal metal fitting than in conventional cases. This enables miniaturization of the housing itself because the positions of the retainer etc. come closer to the tip side of the terminal metal fitting.

According to third aspect of the invention, relating to the item (3), the opening area of the lock hole is increased because the portion around the lock hole is cut and erected. It becomes possible to use a larger lock projection by the increase of the opening area of the lock hole and hence allows the lock projection to withstand deeper biting even if an end surface of the lock hole bites into the lock projection when, for example, the terminal metal fitting is used. As a result, the engagement structure having this configuration can suppress positional deviation of each terminal metal fitting in the associated terminal housing chamber more properly than conventional structures do.

The invention can provide a terminal metal fitting and an engagement structure of a housing and terminal metal fittings which make it possible to suppress positional deviation of a terminal metal fitting in each terminal housing chamber of the housing.

Several aspects of the invention have been described briefly above. The further details of the invention will be made clearer if the following description is read through with reference to the accompanying drawings.

DETAILED DESCRIPTION

Embodiment

A terminal metal fitting 10 and an engagement structure 1 of terminal metal fittings 10 and a housing 20 according to an embodiment of the present invention will be hereinafter described with reference to the drawings. In the following, for convenience of description, in the axial direction (fitting direction) of each terminal metal fitting 10, the side (left side in FIGS. 1A and 1B to FIG. 4) of fitting of a counterpart terminal (not shown) will be referred to as a tip side (or front side) and the side (right side in FIGS. 1A and 1B to FIG. 4) opposite to the tip side will be referred to as a base side (or rear side). Furthermore, the top side and the bottom side are defined as those in FIGS. 1A and 1B to FIG. 4.

Figure 3A:
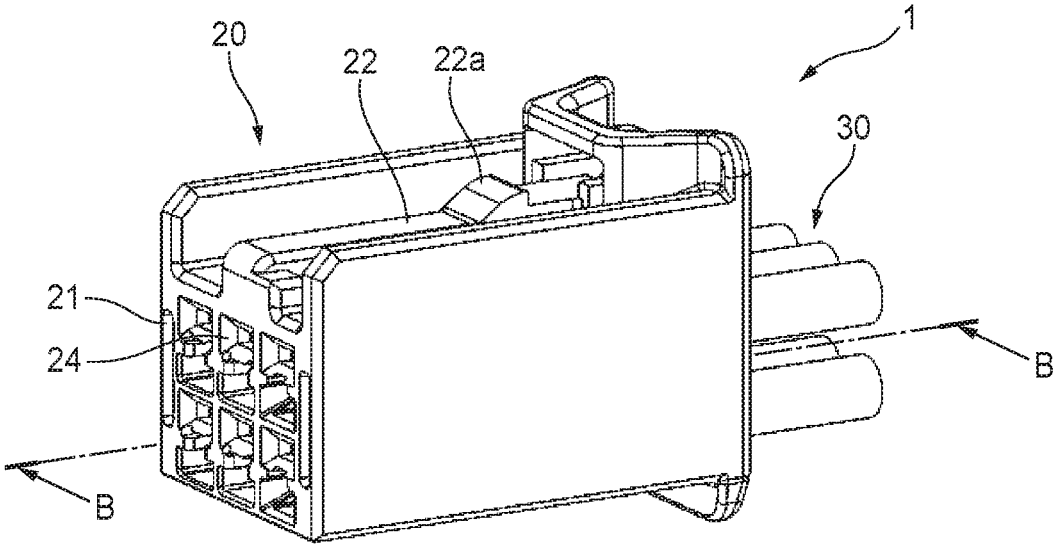
FIG. 3A is a perspective view showing a state that terminal metal fittings each of which is shown in FIGS. 1A and 1B are housed in a housing.
Figure 3B:
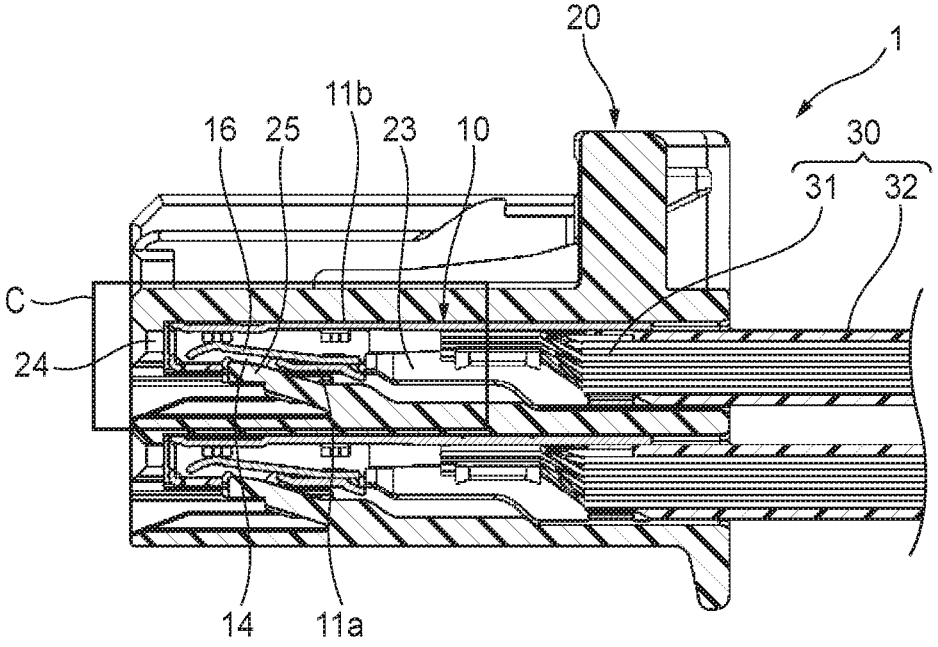
FIG. 3B is a sectional view taken ling line B-B in FIG. 3A.

As shown in FIGS. 3A and 3B, the engagement structure 1 is equipped with the terminal metal fittings 10 to which terminated end portions of electric wires 30 are connected, respectively, and the housing 20 which houses the terminal metal fittings 10. As shown in FIG. 3B, each electric wire 30 is composed of a core wire 31 and a resin covering 32 which covers the core wire 31.

Figure 1A:
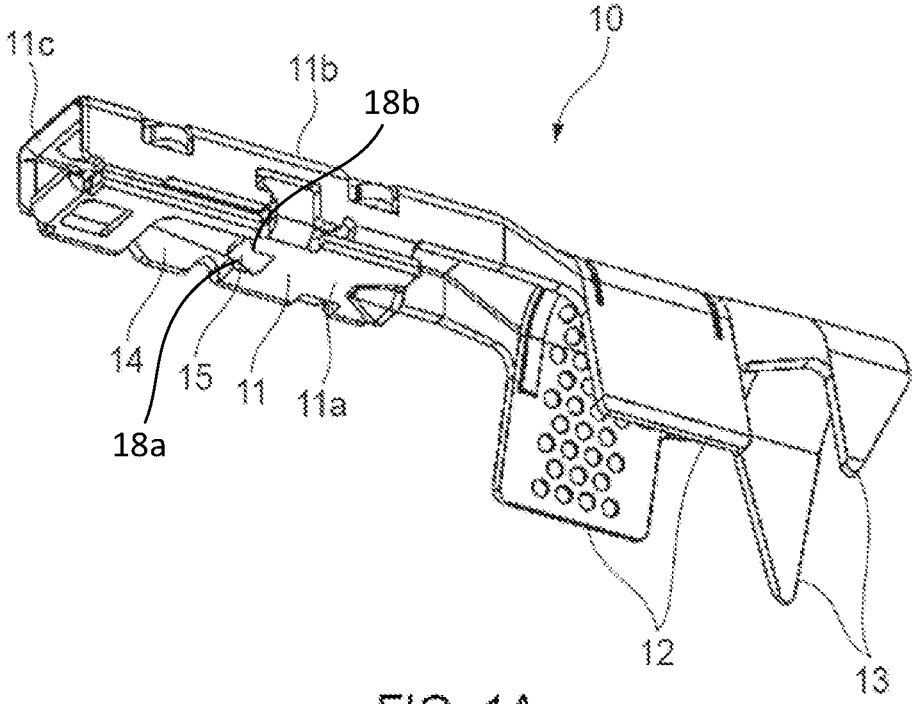
FIG. 1A is a perspective view of a terminal metal fitting according to an embodiment.
Figure 1B:
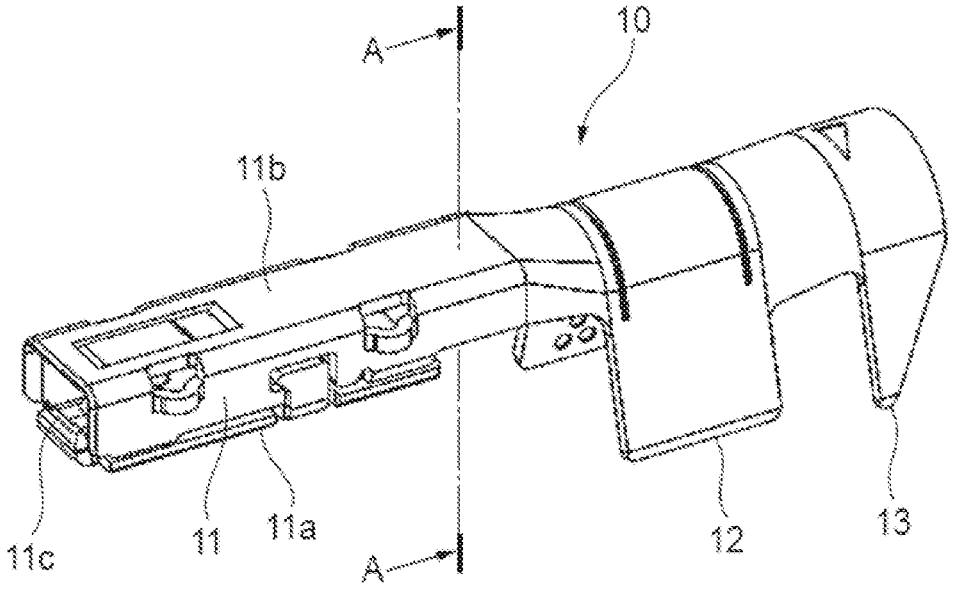
FIG. 1B is a perspective view of the terminal metal fitting as viewed from an angle that is different than in FIG. 1A.
Figure 2:
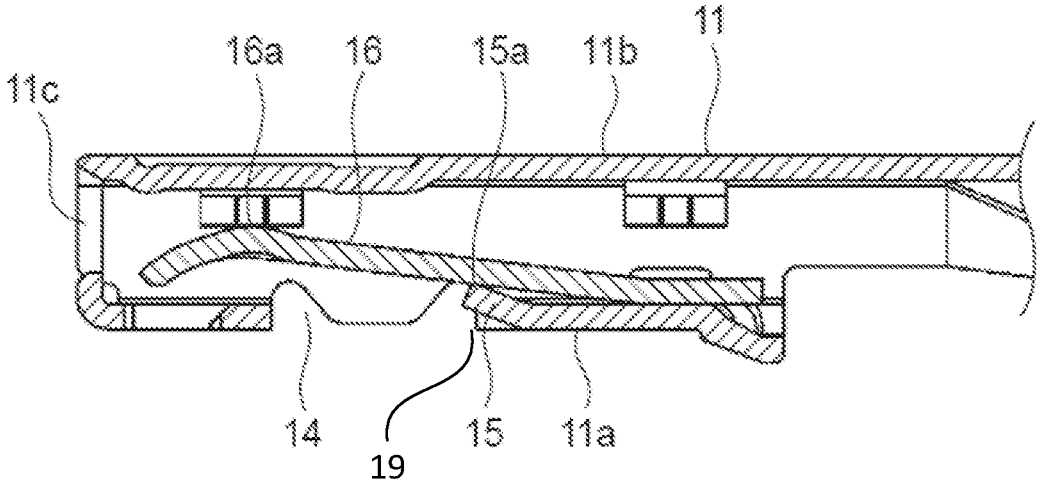
FIG. 2 is a sectional view taken along line A-A in FIG. 1B.

As shown in FIGS. 1A and 1B and FIG. 2, each terminal metal fitting 10 is a female terminal formed by pressing a metal plate and is equipped with a rectangular-cylinder-shaped box portion 11 into which a counterpart terminal (male terminal (not shown)) is to be fitted, core wire swaging pieces 12 for crimping the core wire 31 of an electric wire 30, and covering swaging pieces 13 to be swaged on the covering 32 of the electric wire 30 and thereby fix the electric wire 30.

As shown in FIGS. 1A and 2, a bottom wall 11*a* of the box portion 11 is formed with, approximately at the center in the fitting direction, a rectangular lock hole 14 (through-hole) for receiving a lance 25 (see FIGS. 3B and 4; described later) which is provided in the housing 20.

A portion, around a base-side end surface of the lock hole 14, of the bottom wall 11*a* of the box portion 11, is formed with, at the center in the width direction, a supporting point portion 15 which is a cut-and-erected piece that is cut-separated and erected obliquely toward the inside of the box portion 11 (i.e., upward) and toward the tip side like a cantilever. The width of the supporting point portion 15 is a little greater than that of the lance 25. Thus, the lock hole 14 and the supporting point portion 15 form a space that can function as a space capable of receiving part of the lance 25.

As shown in FIG. 2, a plate-like terminal spring 16 is provided on the inner surface (top surface) of the bottom wall 11*a* of the box portion 11 so as to extend obliquely to the inside of the box portion 11 (i.e., upward) from a position on the base side of the lock hole 14 to a position on the tip side of the lock hole 14 like a cantilever and to stride the lock hole 14. A tip portion 15*a* of the supporting point portion 15 is in contact with or opposed with a slight gap to the bottom surface of the terminal spring 16 at a position around the center of its extension direction.

A tip portion of the terminal spring 16 is bent downward. A counterpart terminal (male terminal) that is inserted through a tip-side opening 11*c* of the box portion 11 is sandwiched between a top projection end 16*a* of the tip portion of the terminal spring 16 and a top wall 11*b* of the box portion 11. When in this manner the terminal spring 16 is pressed against and brought into contact with the counterpart terminal, the tip portion 15*a* of the supporting point portion 15 functions as a supporting point for the terminal spring 16 that is deformed downward elastically. These features will be described later in detail.

As shown in FIGS. 3A and 3B, the housing 20 is equipped with a terminal housing portion 21 for holding the terminal metal fittings 10 and a lock arm 22 which is provided on a top surface of the terminal housing portion 21 and has a lock projection 22*a*. When the housing 20 is fitted into a counterpart housing (not shown) which houses counterpart terminals, the lock arm 22 is engaged with an engagement portion of the counterpart housing. As such, the lock arm 22 performs a function of locking a connection state of the two housings.

The terminal housing portion 21 is equipped with terminal housing chambers 23 for housing the respective terminal metal fittings 10, insertion holes 24 through which the respective counterpart terminals are to be inserted, and the lances 25.

As shown in FIG. 3B, the terminal housing chambers 23 are open on the base side of the housing 20 and the terminal metal fittings 10 are inserted into the respective terminal housing chambers 23 from the base side of the housing 20.

As shown in FIG. 3B, each insertion hole 24 is open at the tip of the associated terminal housing chamber 23 and communicates with that terminal housing chamber 23. A counterpart terminal is inserted into the terminal housing chamber 23 through the insertion hole 24 and fitted into the box portion 11 of the terminal metal fitting 10 held in the terminal housing chamber 23. As a result, a state is maintained that the counterpart terminal and the terminal metal fitting 10 are electrically connected to each other.

As shown in FIG. 3B, the lance 25 is provided on the bottom surface, opposed to the bottom wall 11*a* of the box portion 11 of the terminal metal fitting 10 housed in the terminal housing chamber 23, of the terminal housing chamber 23. The lance 25 is an elastic piece that extends obliquely toward the inside of the terminal housing chamber 23 (i.e., upward) and toward the tip side like a cantilever from a prescribed position on the bottom surface of the terminal housing chamber 23.

Figure 4:
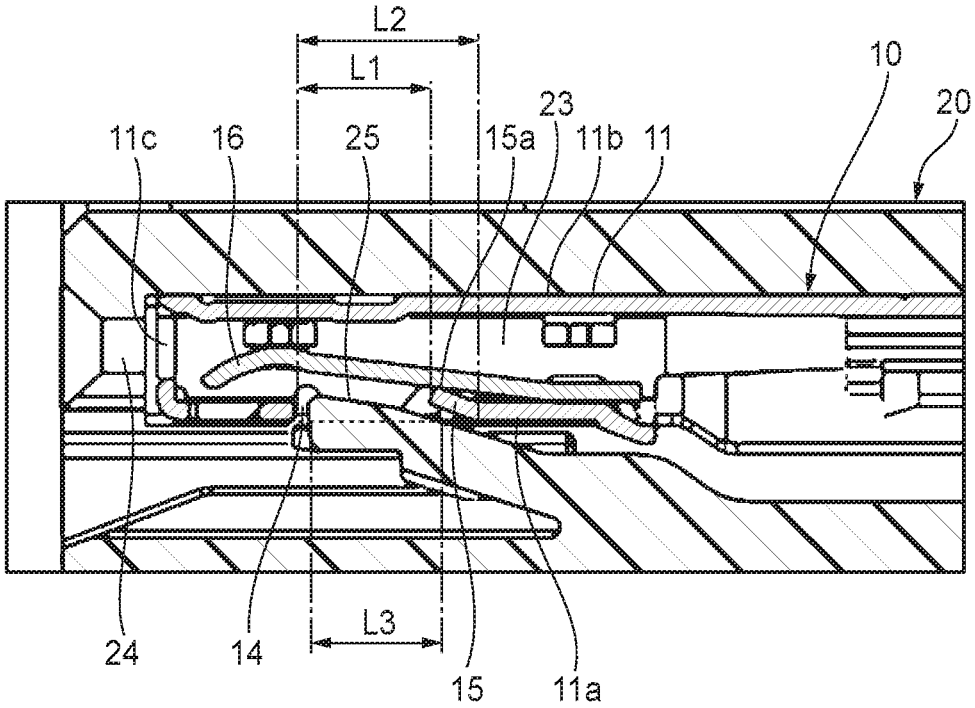
FIG. 4 is an enlarge view of part C of FIG. 3B.

In a halfway state of insertion of the terminal metal fitting 10 into the terminal housing chamber 23, the lance 25 is deformed downward elastically by interference with the bottom wall 11*a* of the box portion 11 of the terminal metal fitting 10. Upon completion of the insertion of the terminal metal fitting 10, the lance 25 returns to the original state while going into the lock hole 14 of the box portion 11 by its own elastic recovering ability. As a result, as shown in FIGS. 3B and 4, the lance 25 is received by the lock hole 14. Thus, a state is established that the tip surface of the lance 25 and the tip-side surface of the lock hole 14 are engaged with each other, whereby the terminal metal fitting 10 is prevented from coming off the terminal housing chamber 23.

As shown in FIG. 4, in a state that the lance 25 is received by the lock hole 14, whereas part of the lance 25 is located in the space formed between the lock hole 14 and the terminal spring 16 of the terminal metal fitting 10, the terminal spring 16 is not in contact with the lance 25. When the counterpart terminal is inserted further into the box portion 11 of the terminal metal fitting 10 from the state of FIG. 4, though the terminal spring 16 is pushed downward (toward the lance 25), downward deformation (toward the lance 25) of the terminal spring 16 is restricted because the tip portion 15*a* of the supporting point portion 15 functions as a supporting point for the terminal spring 16. As a result, the terminal spring 16 can be prevented reliably from interfering with the lance 25.

Furthermore, since the supporting point portion 15 is cut-separated and erected from the base-side end portion of the lock hole 14, the space between the lock hole 14 and the supporting point portion 15 (including a frontward area 19 (see FIG. 2) vacated by erecting the cut-separated supporting point portion 15) can function as a space for receiving part of the lance 25. The supporting point portion 15 is cut-separated by a first cut 18*a* and second cut 18*b*, both extending in the fitting direction. The first and second cuts are disposed more inwardly (i.e., towards an interior), in a width-wise direction, than the side walls of box portion 11. Thus, the dimension in the fitting direction, relating to reception of the lance 25, of the lock hole 14 is increased from a dimension L1 of a case that the supporting point portion 15 is not formed to a dimension L2 of this structure (see FIG. 4). This makes it possible to receive, through the lock hole 14, a larger lance 25 than in the case that the supporting point portion 15 is not formed.

In the following, a dimension in the fitting direction of a cross section obtained by cutting the lance 25 received by the lock hole 14 by a plane containing the opening of the lock hole 14 will be referred to as a shearing distance L3 (see FIG. 4). When external force acts on the terminal metal fitting 10 in such a direction as to pull it out from the terminal housing chamber 23, the tip-side surface of the lock hole 14 pushes the tip surface of the lance 25, whereby shearing stress acts on the lance 25 in the fitting direction.

In the embodiment, the terminal metal fitting 10 can receive, through the lock hole 14, a lance 25 that is increased in the shearing distance L3 by the increase of the dimension in the fitting direction, relating to reception of the lance 25, of the lock hole 14 from L1 to L2. Thus, when external force as mentioned above is exerted on the terminal metal fitting 10, the shearing stress that acts on the lance 25 in the fitting direction is decreased by a value corresponding to the increase of the shearing distance L3. As a result, when external force is exerted on the terminal metal fitting 10, the lance 25 is less prone to be deformed. Even if the tip-side surface of the lock hole 14 bites into the lance 25, the lance 25 can withstand deeper biting by the increase of the shearing distance L3.

In the terminal metal fitting 10 and the engagement structure 1 according to the embodiment of the invention, the opening area of the lock hole 14 is increased because a portion around the lock hole 14 is cut and erected. It becomes possible to receive, through the lock hole 14, a larger lance 25 by the increase of the opening area. When external force is exerted on the terminal metal fitting 10 being in use, there may occur an event that an end surface of the lock hole 14 bites into the lance 25. In this case, where the lance 25 is large, it can withstand deeper biting. As a result, inclination of the terminal metal fitting 10 in the terminal housing chamber 23 can be suppressed.

Furthermore, the space between the lock hole 14 and the terminal spring 16 can be used as a space for receiving the lance 25. As a result, since the internal space of the box portion 11 of the terminal metal fitting 10 can be utilized effectively, the terminal metal fitting 10 can be miniaturized without imparting its function. Moreover, even if the terminal spring 16 is pushed by an inserted counterpart terminal in such a direction as to come closer to the lance 25, since the deformation of the terminal spring 16 toward the lance 25 is restricted by the supporting point portion 15, the interference of the terminal spring 16 with the lance 25 is suppressed. As a result, the function of the terminal metal fitting 10 is maintained even if it is miniaturized.

Still further, since the terminal metal fitting 10 can be miniaturized as described above, it is possible to give the terminal metal fitting 10 an additional function. For example, a portion to engage with a retainer for double locking can be provided at a position (e.g., a position on the side of the rear end of the box portion 11) that is closer to the tip of the terminal metal fitting 10 than in conventional cases. This contributes to miniaturization of the connector structure resultantly.

Other Embodiments

In addition, the invention is not limited to the aforementioned embodiments, but various modifications can be used within the scope of the invention. For example, the invention is not limited to the aforementioned embodiments, but changes, improvements, etc. can be made on the invention suitably. In addition, materials, shapes, dimensions, numbers, arrangement places, etc. of respective constituent elements in the aforementioned embodiments are not limited. Any materials, any shapes, any dimensions, any numbers, any arrangement places, etc. may be used as long as the invention can be attained.

In the above-described embodiment, the box portion 11 of each terminal metal fitting 10 is shaped like a rectangular cylinder. However, the box portion 11 of each terminal metal fitting 10 may be shaped like a circular cylinder, in which case an electric wire to be connected to each terminal metal fitting 10 may be a coaxial cable.

The features of the above-described terminal metal fitting 10 and engagement structure 1 according to the embodiment of the invention will be summarized concisely below in the form of items [1] to [3]:

[1] A terminal metal fitting (10) locked in a terminal housing chamber (23) by using a lock projection (25) provided in a housing (20), the terminal metal fitting (10) comprising:

a tubular box portion (11) receiving a counterpart terminal;

a lock hole (14) formed through a wall (11*a*) of the box portion (11) and receiving the lock projection (25);

a terminal spring (16) extending from an inner wall surface of the box portion (11) to press and contact to the counterpart terminal; and a supporting point portion (15) formed by cutting a portion around the lock hole (14) and erecting the cut portion inside of the box portion (11) to have a cantilevered-shape, the supporting point portion (15) serving as a supporting point (15*a*) upon the terminal spring (16) pressing and contacting to the counterpart terminal.

[2] The terminal metal fitting (10) according to the item [1], wherein the terminal spring (16) extends to stride the lock hole (14) and is located to eliminate a contact with the lock projection (25) received through the lock hole (14); and the supporting point portion (15) supports the terminal spring (16) to restrict deformation of the terminal spring (16) toward the lock projection (25).

[3] An engagement structure (1) of a terminal metal fitting (10) and a housing (20), the engagement structure (1) comprising:

the terminal metal fitting (10) according to the item [1] or the item [2]; and the housing (20) having a terminal housing chamber (23) to receive the terminal metal fitting (10) and a lock projection (25) to lock the terminal metal fitting (10) in the terminal housing chamber (23).

REFERENCE SIGNS LIST

1: Engagement structure
10: Terminal metal fitting
11: Box portion
11*a*: Bottom wall
14: Lock hole
15: Supporting point portion
15*a*: Tip portion (supporting point)
16: Terminal spring
20: Housing
23: Terminal housing chamber
25: Lance (engagement projection)

The invention claimed is:

1. A terminal metal fitting locked in a terminal housing chamber by using a lock projection provided in a housing, the lock projection extending obliquely into the terminal housing chamber, the terminal metal fitting comprising:

a tubular box portion receiving a counterpart terminal through an insertion opening;

a lock hole formed through a wall of the box portion and receiving the lock projection;

a terminal spring extending from an inner wall surface of the box portion in an extending direction, a pressing end of the terminal spring being configured to press and contact the counterpart terminal, the pressing end of the terminal spring being a free-end, the insertion opening being disposed closer to, in the extending direction, the pressing end of the terminal spring than to an opposite end, in the extending direction, of the terminal spring, the opposite end of the terminal spring being opposite to the pressing end in the extending direction; and a supporting point portion which is a cut portion around the lock hole and wherein the cut portion is erected obliquely inside of the box portion to have a cantilevered-shape extending frontwardly, the cut portion being defined by a first cut and a second cut both extending in the extending direction, the first cut and the second cut each being disposed between a respective edge, in the width direction, of the wall of the box portion in which the lock hole is formed, and a center line of the wall in the width direction, the supporting point portion serving as a supporting point upon the terminal spring pressing and contacting to the counterpart terminal, wherein the supporting point portion defines a frontward area vacated by erecting the cut portion, and a portion of the lock projection is located inside the frontward area upon the lock projection being received into the lock hole, wherein the supporting point portion at least partially overlaps, in an overlapping direction, a portion of the lock projection extending through the lock hole, wherein the overlapping direction is perpendicular to the extending direction and parallel to a direction in which the terminal spring presses and contacts the counterpart terminal, wherein the terminal spring extends to stride the lock hole and is located to not contact the lock projection received through the lock hole when the terminal spring is in a non-deformed state, and wherein the supporting point portion supports the terminal spring to restrict deformation of the terminal spring toward the lock projection.

2. An engagement structure of a terminal metal fitting and a housing, the engagement structure comprising:

the terminal metal fitting according to claim 1; and the housing having a terminal housing chamber to receive the terminal metal fitting and a lock projection to lock the terminal metal fitting in the terminal housing chamber.

3. The terminal metal fitting according to claim 1, wherein the opposite end of the terminal spring is disposed at a same position, in the extending direction, as a position at which a part of the supporting point portion is also disposed.

4. The terminal metal fitting according to claim 1, wherein the supporting point portion is located closer to the opposite end of the terminal spring than to the pressing end of the terminal spring, and wherein the opposite end contacts the inner wall surface of the box portion.

* * * * *